US011215031B2

(12) United States Patent
Palmer et al.

(10) Patent No.: US 11,215,031 B2
(45) Date of Patent: Jan. 4, 2022

(54) LOCKING BACKPRESSURE VALVE WITH SHIFTABLE VALVE SLEEVE

(71) Applicants: Larry Thomas Palmer, Spring, TX (US); Erik Van Steveninck, Houston, TX (US); Steve Wilson, III, Magnolia, TX (US)

(72) Inventors: Larry Thomas Palmer, Spring, TX (US); Erik Van Steveninck, Houston, TX (US); Steve Wilson, III, Magnolia, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/889,872

(22) Filed: Jun. 2, 2020

(65) Prior Publication Data

US 2021/0372231 A1 Dec. 2, 2021

(51) Int. Cl.
*E21B 34/14* (2006.01)
*E21B 34/10* (2006.01)

(52) U.S. Cl.
CPC ..... *E21B 34/14* (2013.01); *E21B 34/102* (2013.01); *E21B 34/142* (2020.05); *E21B 2200/05* (2020.05); *E21B 2200/06* (2020.05); *E21B 2200/08* (2020.05)

(58) Field of Classification Search
CPC ..... E21B 34/14; E21B 34/142; E21B 34/102; E21B 2200/06; E21B 2200/05
See application file for complete search history.

(56) References Cited

U.S. PATENT DOCUMENTS 3,289,693 A 12/1966 Scaramucci
3,376,935 A 4/1968 Baker
3,951,338 A 4/1976 Genna
3,958,633 A * 5/1976 Britch ..... E21B 23/03 166/117.5

(Continued)

FOREIGN PATENT DOCUMENTS

CN 10341091 A 11/2013
CN 110173233 A 8/2019

(Continued)

OTHER PUBLICATIONS

International Search Report and Written Opinion for International Application No. PCT/US2019/026878; International Filing Date Apr. 11, 2019; dated Jul. 26, 2019 (pp. 1-8).

(Continued)

*Primary Examiner* — Michael R Wills, III
(74) *Attorney, Agent, or Firm* — Cantor Colburn LLP

(57) ABSTRACT

A downhole tool includes a tubular having an outer surface and an inner surface defining a flowbore having a longitudinal axis, and a backpressure valve cartridge arranged in the flowbore. The backpressure valve cartridge includes a passage, a valve seat arranged in the passage, a flapper valve pivotally mounted relative to the valve seat in the passage, and a piston member configured to shift the flapper valve between a first position, wherein the flapper valve is free to pivot relative to the valve seat, and a second position, wherein the flapper valve is pivoted away from the valve seat and maintained in an open configuration.

17 Claims, 3 Drawing Sheets

(56) References Cited

U.S. PATENT DOCUMENTS

| | | | | |
|---|---|---|---|---|
| 4,033,429 | A | 7/1977 | Farr | |
| 4,100,969 | A * | 7/1978 | Randermann, Jr. | E21B 34/12 166/324 |
| 4,220,206 | A | 9/1980 | Van Winkle | |
| 4,393,930 | A | 7/1983 | Ross et al. | |
| 4,407,329 | A | 10/1983 | Huebsch et al. | |
| 4,474,241 | A | 10/1984 | Freeman | |
| 4,566,541 | A | 1/1986 | Moussy et al. | |
| 4,597,449 | A | 7/1986 | Keeney | |
| 4,676,307 | A | 6/1987 | Pringle | |
| 4,729,432 | A | 3/1988 | Helms | |
| 4,782,895 | A | 11/1988 | Jacob et al. | |
| 5,022,427 | A | 6/1991 | Churchman et al. | |
| 5,159,981 | A | 11/1992 | Le | |
| 5,496,044 | A | 3/1996 | Beall et al. | |
| 6,260,850 | B1 | 7/2001 | Beall et al. | |
| 6,446,665 | B2 | 9/2002 | Coscarella | |
| 6,547,007 | B2 | 4/2003 | Szarka et al. | |
| 6,568,470 | B2 * | 5/2003 | Goodson, Jr. | E21B 23/04 166/66.5 |
| 6,957,703 | B2 * | 10/2005 | Trott | E21B 34/10 166/332.8 |
| 7,063,156 | B2 * | 6/2006 | Patel | E21B 34/12 166/332.8 |
| 7,299,880 | B2 | 11/2007 | Logiudice et al. | |
| 7,360,600 | B2 | 4/2008 | MacDougall et al. | |
| 7,665,528 | B2 | 2/2010 | Ross et al. | |
| 8,607,811 | B2 | 12/2013 | Korkmaz | |
| 8,893,796 | B2 | 11/2014 | Conner et al. | |
| 8,955,543 | B2 | 2/2015 | Groesbeck et al. | |
| 9,163,479 | B2 | 10/2015 | Rogers et al. | |
| 10,619,448 | B1 | 4/2020 | Watson et al. | |
| 2001/0023706 | A1 | 9/2001 | Coscarella | |
| 2003/0121665 | A1 | 7/2003 | Trott et al. | |
| 2004/0060704 | A1 | 4/2004 | Layton et al. | |
| 2007/0137869 | A1 | 6/2007 | MacDougall et al. | |
| 2010/0139923 | A1 | 6/2010 | Biddick | |
| 2010/0212907 | A1 | 8/2010 | Frazier | |
| 2011/0088908 | A1 | 4/2011 | Xu | |
| 2011/0174505 | A1 | 7/2011 | Gill et al. | |
| 2011/0290344 | A1 | 12/2011 | Groesbeck et al. | |
| 2012/0305257 | A1 | 12/2012 | Conner et al. | |
| 2012/0321446 | A1 | 12/2012 | Blewett et al. | |
| 2014/0020904 | A1 | 1/2014 | Hill, Jr. | |
| 2015/0136404 | A1 | 5/2015 | Groesbeck et al. | |
| 2015/0211333 | A1 | 7/2015 | Vick, Jr. et al. | |
| 2016/0138365 | A1 | 5/2016 | Vick, Jr. et al. | |
| 2016/0138368 | A1 | 5/2016 | Girola | |
| 2016/0230503 | A1 | 8/2016 | Holmberg et al. | |
| 2016/0281465 | A1 | 9/2016 | Grayson et al. | |
| 2016/0341002 | A1 | 11/2016 | McKitrick, III | |
| 2017/0175488 | A1 | 6/2017 | Lisowski et al. | |
| 2017/0370186 | A1 | 12/2017 | Stair | |
| 2018/0058177 | A1 | 3/2018 | Bigrigg et al. | |
| 2018/0209246 | A1 * | 7/2018 | Miller | E21B 23/006 |
| 2018/0334833 | A1 | 11/2018 | Brewer | |
| 2018/0334883 | A1 | 11/2018 | Williamson | |
| 2018/0347301 | A1 | 12/2018 | Hilliard et al. | |
| 2019/0003286 | A1 | 1/2019 | Bigrigg et al. | |
| 2019/0331235 | A1 | 10/2019 | Prather et al. | |
| 2019/0338620 | A1 | 11/2019 | Burris et al. | |
| 2020/0190941 | A1 | 6/2020 | Watson et al. | |

FOREIGN PATENT DOCUMENTS

| | | | |
|---|---|---|---|
| EP | 2535504 | A1 | 12/2012 |
| EP | 3561220 | A1 | 10/2019 |
| WO | 2004031534 | A1 | 4/2004 |
| WO | 2006024811 | A1 | 3/2006 |
| WO | 2007073401 | A1 | 6/2007 |
| WO | 2007125335 | A1 | 11/2007 |
| WO | 2017052556 | A1 | 3/2017 |

OTHER PUBLICATIONS

International Search Report and Written Opinion for International Application No. PCT/US2021/034166; International Filing Date May 26, 2021; Report dated Aug. 27, 2021 (pp. 1-11).

International Search Report and Written Opinion for International Application No. PCT/US2021/034170; International Filing Date May 26, 2021; Report dated Aug. 27, 2021 (pp. 1-11).

International Search Report and Written Opinion for International Application No. PCT/US2021/034167; International Filing Date May 26, 2021; Report dated Sep. 14, 2021 (pp. 1-10).

International Search Report and Written Opinion for International Application No. PCT/US2021/034168; International Filing Date May 26, 2021; Report dated Sep. 3, 2021 (pp. 1-11).

International Search Report and Written Opinion for International Application No. PCT/US2021/034173; International Filing Date May 26, 2021; Report dated Sep. 16, 2021 (pp. 1-10).

International Search Report and Written Opinion for International Application No. PCT/US2021/034174; International Filing Date May 26, 2021; Report dated Aug. 30, 2021 (pp. 1-10).

International Search Report and Written Opinion for International Application No. PCT/US2021/034175; International Filing Date May 26, 2021; Report dated Sep. 16, 2021 (pp. 1-11).

* cited by examiner

LOCKING BACKPRESSURE VALVE WITH SHIFTABLE VALVE SLEEVE

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed, and a production string is run downhole to begin production. Withdrawing and running-in strings including drill strings and production strings is a time consuming and costly process. The industry would be open to systems that would reduce costs and time associated with plug removal and resource production.

SUMMARY

Disclosed is a downhole tool including a tubular having an outer surface and an inner surface defining a flowbore having a longitudinal axis, and a backpressure valve cartridge arranged in the flowbore. The backpressure valve cartridge includes a passage, a valve seat arranged in the passage, a flapper valve pivotally mounted relative to the valve seat in the passage, and a piston member configured to shift the flapper valve between a first position, wherein the flapper valve is free to pivot relative to the valve seat, and a second position, wherein the flapper valve is pivoted away from the valve seat and maintained in an open configuration.

Also disclosed is a resource exploration and recovery system including a first system and a second system fluidically connected to the first system. The second system includes at least one tubular extending into a formation. The at least one tubular supports a downhole tool and includes an outer surface and an inner surface defining a flowbore having a longitudinal axis. The downhole tool includes a backpressure valve cartridge arranged in the flowbore. The backpressure valve cartridge includes a passage, a valve seat arranged in the passage, a flapper valve pivotally mounted relative to the valve seat in the passage, and a piston member configured to shift the flapper valve between a first position, wherein the flapper valve is free to pivot relative to the valve seat, and a second position, wherein the flapper valve is pivoted away from the valve seat and maintained in an open configuration.

Still further disclosed is a method of operating a backpressure valve includes shifting a sleeve arranged in a passage of a backpressure valve cartridge including a flapper valve along a longitudinal axis of a flowbore, exposing a piston to tubing pressure from the passage, shifting the piston into contact with the flapper valve, and pivoting the flapper valve about a hinge from a first position, wherein the flapper valve is free to rotate about the hinge, to a second position, wherein the flapper valve is pivoted away from a valve seat and maintained in an open configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
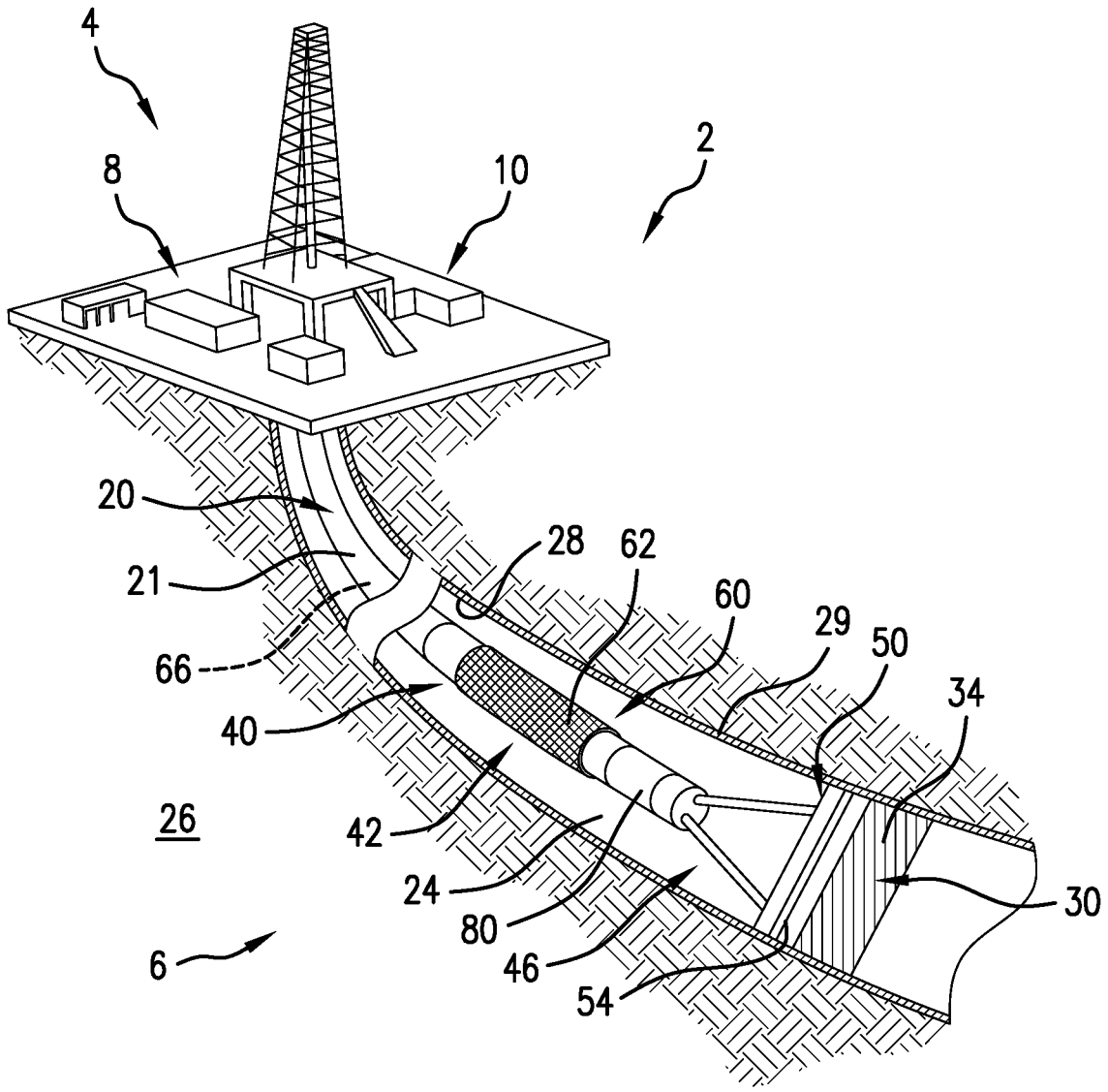
FIG. 1 depicts a resource exploration and recovery system including a locking backpressure valve, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which takes the form of a surface system operatively connected to a second system 6 which takes the form of a subsurface or subterranean system. First system 4 may include pumps 8 that aid in completion and/or extraction processes as well as fluid storage 10. Fluid storage 10 may contain a gravel pack fluid or slurry, or drilling mud (not shown) or other fluid which may be introduced into second system 6.

Second system 6 may include a downhole string 20 formed from one or more tubulars such as indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, subsurface system 6 may include a downhole zonal isolation device 30 that may form a physical barrier between one portion of wellbore 24 and another portion of wellbore 24. Downhole zonal isolation device 30 may take the form of a bridge plug 34. Of course, it is to be understood that downhole zonal isolation device 30 may take on various forms including frac plugs formed from composite materials and/or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Plug removal and production system 42 includes a selective sand screen 60 arranged uphole of BHA 46. Selective sand screen 60 includes a screen element 62 that is arranged over a plurality of openings (not shown) formed in drill string 40. It is to be understood that the number of screen elements may vary. Further, it is to be understood that screen opening size may vary. It is also to be understood that screen element 62 may include a number of screen layers. The openings in drill string 40 fluidically connect wellbore 24 with a flow path 66 extending through drill string 40.

Figure 2:
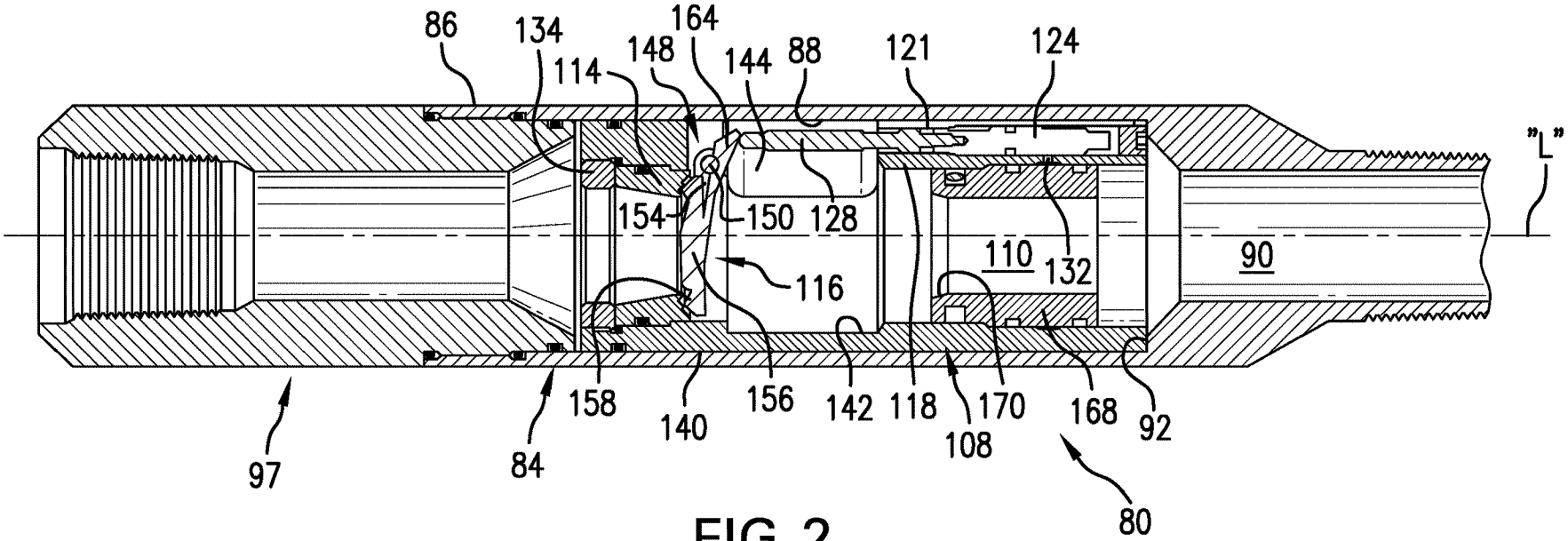
FIG. 2 depicts a cross-sectional side view of the locking backpressure valve in a run-in configuration, in accordance with an exemplary aspect.

In yet still further accordance with an exemplary embodiment, plug removal and production system 42 includes a backpressure valve (BPV) 80 arranged downhole of selective sand screen 60 and uphole of BHA 46. Referring to FIG. 2, BPV 80 includes a tubular 84 that forms part of drill string 40. Tubular 84 includes an outer surface 86 and an inner surface 88 that defines a flowbore 90 having a longitudinal axis "L" that receives BPV 80. Inner surface 88 includes a recessed section 92. In addition, tubular 84 is shown to include a connector 97 that may be removed to provide access to flowbore 90.

In accordance with an exemplary aspect, BPV 80 includes a backpressure cartridge (BPC) 108 arranged in flowbore 90 and secured in recessed section 92. BPC 108 includes a passage 110, a valve seat 114 arranged in passage 110, and a flapper valve 116 pivotally mounted relative to valve seat 114. BPC 108 also includes a piston system 118 including a piston chamber 121 that receives a piston member 124. Piston member 124 supports an activator 128 and is arranged in piston chamber 121. Piston chamber 121 defines an atmospheric chamber (not separately labeled) having an inlet 132 that may be selectively fluidically exposed to passage 110. A lock ring 134 may be employed to secure valve seat 114 in BPC 108.

By atmospheric chamber, it should be understood that piston chamber 121 may be filled with a fluid, such as air, a liquid, or the like, at atmospheric pressure. It should also be understood that atmospheric pressure on one side of piston member 124 is balanced by atmospheric pressure on an opposing side of piston member 124 as long as inlet 132 is covered. Balancing pressure in piston chamber 121 ensures that piston member 124 does not shift and prematurely shift flapper valve 116.

Figure 3:
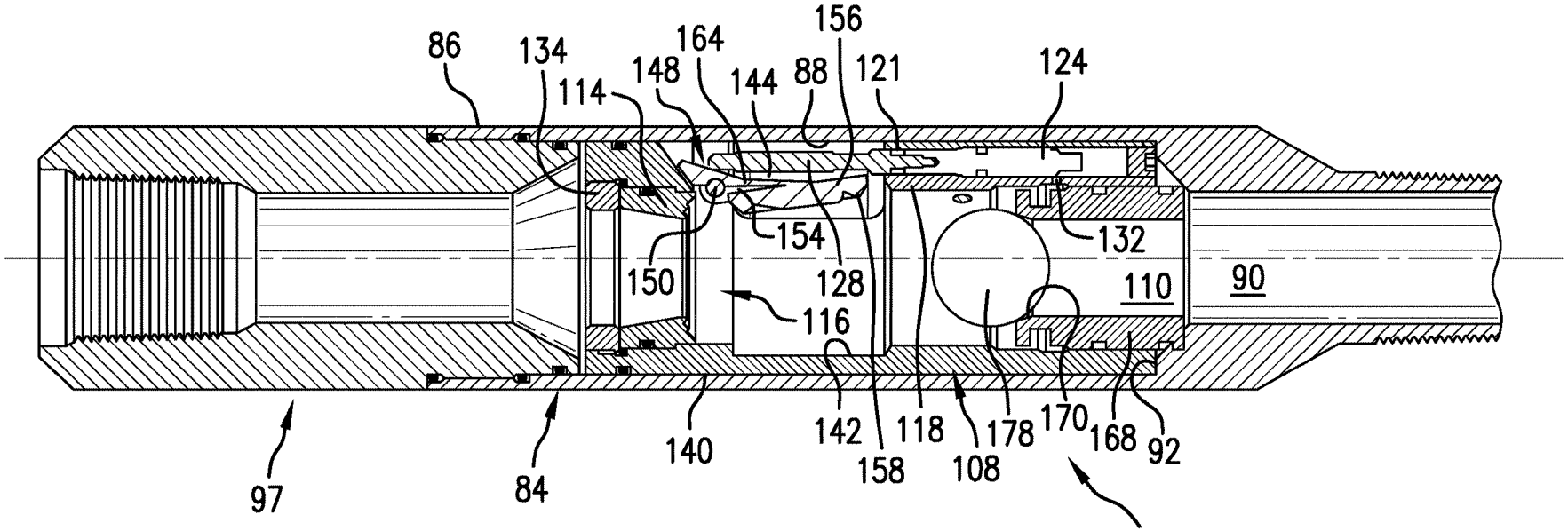
FIG. 3 depicts a cross-sectional side view of the locking backpressure valve in a production configuration, in accordance with an exemplary aspect.

BPC 108 includes an outer surface section 140 and an inner surface section 142, and an opening 144. Opening 144 is selectively receptive of flapper valve 116. BPC 108 includes a hinge 148 that receives a hinge pin 150 that pivotally supports flapper valve 116. Flapper valve 116 includes a hinge portion 154, a valve portion 156 having a sealing surface 158, and a tang element 164. Valve portion 156 extends from hinge portion 154 in a first direction and tang element 164 extends from hinge portion 154 in a second direction that may be opposite the first direction. A selectively slidable sleeve 168 is arranged in passage 110. Selectively slidable sleeve 168 includes a ball seat 170 and covers inlet 132 in a first position (FIG. 2) and uncovers inlet 132 when shifted to a second position (FIG. 3).

In accordance with an exemplary embodiment, after mill 54 opens a downhole most plug (not shown), BHA 46 may be pumped off and allowed to fall and collect at a toe (not shown) of wellbore 24. During drilling, selectively slidable sleeve 168 is arranged in the first position (FIG. 2) whereby flapper valve 116 is free to pivot about hinge 148. In this manner, drilling fluids may pass downhole toward BHA 46, but pressure may not pass uphole beyond BPV 80. That is, pressure moving in an uphole direction would act against and cause flapper valve 116 to close.

After pumping off BHA 46, it may be desirable to produce fluids through drill string 40. As such, selectively slidable sleeve 168 is moved to the second position (FIG. 3) opening flowbore 90. An object, such as a drop ball 178 may be introduced into drill string 40 and allowed to fall onto ball seat 170 of selectively slidable sleeve 168. Pressure is applied to drop ball 178 causing selectively slidable sleeve 168 to shift along the longitudinal axis "L" within passage 110 from the first position to the second position thereby opening inlet 132 and exposing piston chamber 121 to tubular pressure. The tubular pressure causes piston member 124 to shift actuator 128 into contact with tang element 164 causing flapper valve 116 to open. At this point it should be understood that while described as a drop ball, the object may take on various forms including balls, darts, plugs, and the like. Also, while described as employing an object to shift the flapper, other methods, such as tools, tubing pressure, tubing fluid, and the like may also be employed.

Drop ball 178 may be allowed to dissolve opening flowbore 90. Alternatively, additional pressure may be applied causing drop ball 178 to fracture and/or pass through selectively slidable sleeve 168 to open flowbore 90. The presence of tubing pressure in passage 110 causes piston member to maintain pressure on actuator 128 thereby locking flapper valve 116 in the second position.

At this point it should be understood that the exemplary embodiments describe a system for actuating a backpressure valve by shifting a sliding sleeve seat within a self-contained backpressure valve cartridge to expose an atmospheric chamber to tubing pressure. The backpressure valve cartridge includes a valve portion having the valve seat and a flapper valve. The tubing pressure urges a piston into contact with a flapper valve causing the backpressure valve to open. It should be understood that while shown as including one flapper valve, backpressure valve cartridge may include any number of valves.

Set forth below are some embodiments of the foregoing disclosure:

Embodiment 1. A downhole tool comprising: a tubular having an outer surface and an inner surface defining a flowbore having a longitudinal axis; and a backpressure valve cartridge arranged in the flowbore, the backpressure valve cartridge including a passage, a valve seat arranged in the passage, a flapper valve pivotally mounted relative to the valve seat in the passage, and a piston member configured to shift the flapper valve between a first position, wherein the flapper valve is free to pivot relative to the valve seat, and a second position, wherein the flapper valve is pivoted away from the valve seat and maintained in an open configuration.

Embodiment 2. The downhole tool according to any prior embodiment, wherein the backpressure valve cartridge includes an inner surface section and an outer surface section and a hinge including a hinge pin that pivotally supports the flapper valve.

Embodiment 3. The downhole tool according to any prior embodiment, wherein the flapper valve includes a hinge portion that is receptive of the hinge pin and a valve portion including a sealing surface, the valve portion extending radially outwardly of the hinge portion.

Embodiment 4. The downhole tool according to any prior embodiment, wherein the flapper valve includes a tang element that projects radially outwardly of the hinge portion, the piston member selectively engaging the tang element to shift the flapper valve.

Embodiment 5. The downhole tool according to any prior embodiment, wherein the piston member supports an actuator that is selectively shifted into the tang element to pivot the flapper valve from the first position to the second position.

Embodiment 6. The downhole tool according to any prior embodiment, wherein the backpressure valve cartridge includes a piston chamber having an inlet and housing the piston member, and a selectively slidable sleeve that is selectively shifted to expose the inlet to tubing pressure in the passage.

Embodiment 7. The downhole tool according to any prior embodiment, wherein the piston chamber contains fluid at atmospheric pressure.

Embodiment 8. The downhole tool according to any prior embodiment, wherein the selectively slidable sleeve includes a ball seat.

Embodiment 9. A resource exploration and recovery system comprising: a first system; a second system fluidically connected to the first system, the second system including at least one tubular extending into a formation, the at least one tubular supporting a downhole tool and including an outer surface and an inner surface defining a flowbore having a longitudinal axis, the downhole tool comprising: a backpressure valve cartridge arranged in the flowbore, the backpressure valve cartridge including a passage, a valve seat arranged in the passage, a flapper valve pivotally mounted relative to the valve seat in the passage, and a piston member configured to shift the flapper valve between a first position, wherein the flapper valve is free to pivot relative to the valve seat, and a second position, wherein the flapper valve is pivoted away from the valve seat and maintained in an open configuration.

Embodiment 10. The resource exploration and recovery system according to any prior embodiment, wherein the backpressure valve cartridge includes an inner surface section and an outer surface section and a hinge including a hinge pin that pivotally supports the flapper valve.

Embodiment 11. The resource exploration and recovery system according to any prior embodiment, wherein the flapper valve includes a hinge portion that is receptive of the hinge pin and a valve portion including a sealing surface, the valve portion extending radially outwardly of the hinge portion.

Embodiment 12. The resource exploration and recovery system according to any prior embodiment, wherein the flapper valve includes a tang element that projects radially outwardly of the hinge portion, the piston member selectively engaging the tang element to shift the flapper valve.

Embodiment 13. The resource exploration and recovery system according to any prior embodiment, wherein the piston member supports an actuator that is selectively shifted into the tang element to pivot the flapper valve from the first position to the second position.

Embodiment 14. The resource exploration and recovery system according to any prior embodiment, wherein the backpressure valve cartridge includes a piston chamber having an inlet and housing the piston member, and a selectively slidable sleeve that is selectively shifted to expose the inlet to tubing pressure in the passage.

Embodiment 15. The resource exploration and recovery system according to any prior embodiment, wherein the piston chamber contains fluid at atmospheric pressure.

Embodiment 16. The resource exploration and recovery system according to any prior embodiment, wherein the selectively slidable sleeve includes a ball seat.

Embodiment 17. A method of operating a backpressure valve comprising: shifting a sleeve arranged in a passage of a backpressure valve cartridge including a flapper valve along a longitudinal axis of a flowbore; exposing a piston to tubing pressure from the passage; shifting the piston into contact with the flapper valve; and pivoting the flapper valve about a hinge from a first position, wherein the flapper valve is free to rotate about the hinge, to a second position, wherein the flapper valve is pivoted away from a valve seat and maintained in an open configuration.

Embodiment 18. The method according to any prior embodiment, wherein shifting the sleeve includes applying pressure to a drop ball resting on the valve seat.

Embodiment 19. The method according to any prior embodiment, wherein exposing the piston to tubing pressure includes flooding an atmospheric chamber with tubing pressure.

Embodiment 20. The method according to any prior embodiment, further comprising: locking the flapper valve in the second position with wellbore pressure in the passage.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular having an outer surface and an inner surface defining a flowbore having a longitudinal axis; and a backpressure valve cartridge arranged in the flowbore, the backpressure valve cartridge including a passage, a valve seat arranged in the passage, a flapper valve pivotally mounted relative to the valve seat in the passage, a piston chamber having an inlet and housing the piston member, and a selectively slidable sleeve that is selectively shifted to expose the inlet to tubing pressure in the passage, and a piston member arranged in the piston chamber, the piston member being configured to shift the flapper valve between a first position, wherein the flapper valve is free to pivot relative to the valve seat, and a second position, wherein the flapper valve is pivoted away from the valve seat and maintained in an open configuration.

2. The downhole tool according to claim 1, wherein the backpressure valve cartridge includes an inner surface section and an outer surface section and a hinge including a hinge pin that pivotally supports the flapper valve.

3. The downhole tool according to claim 2, wherein the flapper valve includes a hinge portion that is receptive of the hinge pin and a valve portion including a sealing surface, the valve portion extending radially outwardly of the hinge portion.

4. The downhole tool according to claim 3, wherein the flapper valve includes a tang element that projects radially outwardly of the hinge portion, the piston member selectively engaging the tang element to shift the flapper valve.

5. The downhole tool according to claim 4, wherein the piston member supports an actuator that is selectively shifted into the tang element to pivot the flapper valve from the first position to the second position.

6. The downhole tool according to claim 1, wherein the piston chamber contains fluid at atmospheric pressure.

7. The downhole tool according to claim 1, wherein the selectively slidable sleeve includes a ball seat.

8. A resource exploration and recovery system comprising:

a first system;

a second system fluidically connected to the first system, the second system including at least one tubular extending into a formation, the at least one tubular supporting a downhole tool and including an outer surface and an inner surface defining a flowbore having a longitudinal axis, the downhole tool comprising:

a backpressure valve cartridge arranged in the flowbore, the backpressure valve cartridge including a passage, a valve seat arranged in the passage, a flapper valve pivotally mounted relative to the valve seat in the passage, a piston chamber having an inlet and housing the piston member, and a selectively slidable sleeve that is selectively shifted to expose the inlet to tubing pressure in the passage, and a piston member arranged in the piston chamber, the piston member being configured to shift the flapper valve between a first position, wherein the flapper valve is free to pivot relative to the valve seat, and a second position, wherein the flapper valve is pivoted away from the valve seat and maintained in an open configuration.

9. The resource exploration and recovery system according to claim 8, wherein the backpressure valve cartridge includes an inner surface section and an outer surface section and a hinge including a hinge pin that pivotally supports the flapper valve.

10. The resource exploration and recovery system according to claim 9, wherein the flapper valve includes a hinge portion that is receptive of the hinge pin and a valve portion including a sealing surface, the valve portion extending radially outwardly of the hinge portion.

11. The resource exploration and recovery system according to claim 10, wherein the flapper valve includes a tang element that projects radially outwardly of the hinge portion, the piston member selectively engaging the tang element to shift the flapper valve.

12. The resource exploration and recovery system according to claim 11, wherein the piston member supports an actuator that is selectively shifted into the tang element to pivot the flapper valve from the first position to the second position.

13. The resource exploration and recovery system according to claim 9, wherein the piston chamber contains fluid at atmospheric pressure.

14. The resource exploration and recovery system according to claim 9, wherein the selectively slidable sleeve includes a ball seat.

15. A method of operating a backpressure valve comprising:

shifting a sleeve arranged in a passage of a backpressure valve cartridge along a longitudinal axis of a flowbore, the backpressure valve cartridge including a flapper valve;

exposing an inlet of a piston chamber that houses a piston member supporting an activator to tubing pressure from the passage by sliding the sleeve;

shifting the piston member in the piston chamber to move the activator into contact with the flapper valve; and pivoting the flapper valve about a hinge from a first position, wherein the flapper valve is free to rotate about the hinge, to a second position, wherein the flapper valve is pivoted away from a valve seat and maintained in an open configuration.

16. The method of claim 15, wherein shifting the sleeve includes applying pressure to a drop ball resting on the sleeve.

17. The method of claim 15, further comprising: locking the flapper valve in the second position with wellbore pressure in the passage.

* * * * *